US006062198A

United States Patent [19]

Loehr

[11] Patent Number: 6,062,198

[45] Date of Patent: May 16, 2000

[54] METHOD AND ARRANGEMENT FOR OPERATING AN INTERNAL COMBUSTION ENGINE

[75] Inventor: Diethard Loehr, Holzmaden, Germany

[73] Assignee: Robet BoschGmbH, Stuttgart, Germany

[21] Appl. No.: 09/229,755

[22] Filed: Jan. 14, 1999

[30] Foreign Application Priority Data

Jan. 15, 1998 [DE] Germany ..... 198 01 187

[51] Int. Cl.[7] ..... F02D 41/28

[52] U.S. Cl. ..... 123/399; 123/491; 701/113; 701/114

[58] Field of Search ..... 123/399, 491; 701/113, 114

[56] References Cited

U.S. PATENT DOCUMENTS

| | | | |
|---|---|---|---|
| 4,629,907 | 12/1986 | Kosak | 701/114 |
| 4,947,815 | 8/1990 | Peter . | |
| 5,031,177 | 7/1991 | Brauninger | 701/114 |
| 5,184,300 | 2/1993 | Hara et al. | 701/114 |
| 5,213,078 | 5/1993 | Kolberg et al. . | |
| 5,375,246 | 12/1994 | Kimura et al. | 701/114 |
| 5,454,114 | 9/1995 | Yach et al. | 701/114 |
| 5,497,330 | 3/1996 | Ishida | 701/114 |
| 5,682,314 | 10/1997 | Nishino et al. | 701/114 |

FOREIGN PATENT DOCUMENTS

| | | | |
|---|---|---|---|
| 0 143 313 | 6/1985 | European Pat. Off. | 701/114 |

*Primary Examiner*—Erick R. Solis
*Attorney, Agent, or Firm*—Walter Ottesen

[57] ABSTRACT

The invention is directed to a method and an arrangement for operating an internal combustion engine wherein, after an exchange of an electrically-actuable adjusting device and/or after an original start, no injection pulses are outputted for a predetermined time and the start of the engine is prevented.

11 Claims, 3 Drawing Sheets

Ignition Switch-On
100
Are DKNLP and Stored Value within Tolerance?
yes
no
101
Set Injection Inhibit
Return Spring Test
102
104
Adaptation Required?
yes
no
113
106
Start Adaptation
Disable Injection Inhibit, Start Adaptation
yes
Adaptation Ended?
no
114
108
Read In Nmot
Disable Injection Inhibit
116
yes
Nmot > Nmax?
no
110
Interrupt Adaptation
112
End

METHOD AND ARRANGEMENT FOR OPERATING AN INTERNAL COMBUSTION ENGINE

BACKGROUND OF THE INVENTION

U.S. Pat. No. 5,213,078 discloses a method and an arrangement for operating an internal combustion engine and includes an electrically actuable adjusting device. An adaptation operation is executed in this method and arrangement when closing the ignition switch in advance of the start of the engine. Characteristic values are determined in the context of this adaptation operation and are important for the operation of the engine. The values are further important especially with respect to an adjusting device for a throttle flap of the engine. In the known adaptation, the lower mechanical stop of the throttle flap is determined. The value of this stop is considered in the determination of the position of the throttle flap from a measurement signal as well as a desired value for the throttle flap position in the context of the control of the engine.

In addition to such a learning procedure, other characteristic values are determined as may be required in present day engine control systems in the context of an adaptation operation in advance of the start of the engine. These further characteristic values include, for example, the actual emergency air position of the adjusting device (as will be explained below), offset values and slope values of measuring signal amplifiers and/or the performance of a test of the return spring of the adjusting device. In the last-mentioned item, the adjusting device is first driven and is then switched to be without current and the effect of the return spring, which moves the adjusting device into its rest position, is checked based on the return times.

The knowledge of the characteristic values, which are determined during the adaptation operation, is necessary for a trouble-free function sequence of the engine control. For this reason, this adaptation operation should not be interrupted prematurely such as when the driver starts the engine directly after switching on the ignition. This is especially the case when there is an exchange of the adjusting device and/or a so-called original start.

SUMMARY OF THE INVENTION

It is an object of the invention to provide measures which ensure the execution of an adaptation operation in advance of the start of the engine.

The invention includes a method of operating an internal combustion engine equipped with a voltage supply and an electrically actuable adjusting device for adjusting an operating variable of the engine. The method includes the step of inhibiting the output of an injection pulse for a predetermined time when doing at least one of the following: exchanging the adjusting device and when taking the engine into service for the first time after having disconnected the voltage supply.

U.S. Pat. No. 4,947,815 is incorporated by reference and discloses a throttle flap adjusting device which includes springs which hold the throttle flap in the current-less state in a pregiven position (an emergency air position) which is different from the completely closed position.

The invention ensures that the adaptation operation (especially after the exchange of an actuator and/or for the original start) is ended without the adaptation operation being prematurely interrupted because of the start of the engine. The complete execution of the adaptation operation is ensured when, for an adaptation requirement which is present (for example, an exchange of an actuator), an injection inhibit is outputted until the end of the adaptation operation. In this way, it is not possible for the driver to start the engine by further rotating the ignition key.

In an advantageous manner, an actuator exchange is assumed to be present when the measured emergency air position deviates impermissibly from a stored emergency air position.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
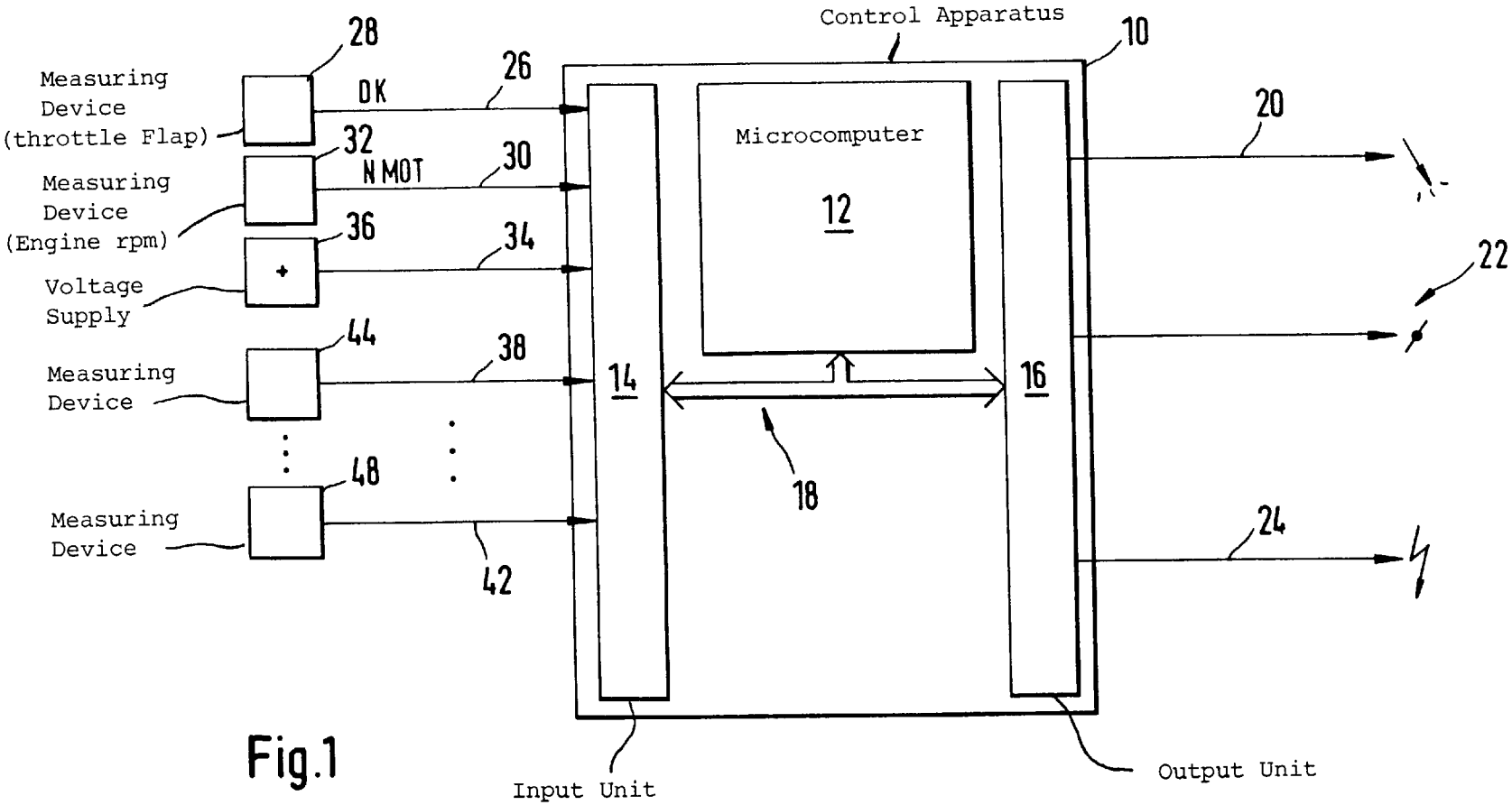
FIG. 1 shows a control apparatus for an internal combustion engine.

FIG. 1 shows a control apparatus 10 for an internal combustion engine which includes a microcomputer 12, an input circuit 14 and an output circuit 16. These elements are interconnected via a communication system 18. In a preferred embodiment, the control apparatus 10 controls via the output circuit 16 the quantity of fuel (symbolized by line 20) to be injected, the air supply by controlling a throttle flap adjusting device 22 as well as the ignition angle (symbolized by line 24). Various input lines are connected to the input circuit 14. There are variables which are important in connection with the procedure explained below. These variables are a signal, which indicates the position DK of the throttle flap, and is supplied from at least one measuring device 28 via an input line 26 and a signal, which indicates the engine rpm Nmot. This signal is supplied from a corresponding measuring device 32 via an input line 30. In addition, the operating voltage 36 is supplied to the control apparatus via a line 34 when the ignition switch is closed. Further input lines 38 to 42 supply the control apparatus 10 with additional measurement quantities needed for carrying out the engine control. These measurement quantities are from corresponding measuring devices 44 to 48. Measuring quantities of this kind are, for example, air mass, accelerator pedal position, exhaust-gas composition, et cetera.

In normal operation of the control apparatus, the control apparatus forms drive signals for the metering of the fuel quantity, to adjust the ignition time point and to adjust the throttle flap adjusting device. The drive signals are formed in the control apparatus on the basis of the supplied measurement signals. Here, in a manner known per se, the accelerator pedal position, engine rpm, air mass and the determined throttle flap position are used. The throttle flap adjusting device itself is adjusted in the context of a position control loop wherein the measured throttle flap position is set into a relationship with a determined desired position for the throttle flap which is dependent upon the accelerator pedal position. In a preferred embodiment, the throttle flap adjusting device 22 is an adjusting device of the kind referred to in the state of the art referred to herein initially.

It is necessary to detect the position at which the throttle flap is completely closed especially for carrying out the position control of the throttle flap. This quantity is used as a reference point for determining the desired and actual values. Furthermore, the position of the emergency air point is important because, at this point, a sign reversal of the torque of the springs occurs. This torque is opposite to the direction of movement of the throttle flap. These values as well as additional values such as, for example, offset values, slope values of measurement signal amplifiers are determined in advance of the start of the engine in the context of an adaptation. For detecting the lower mechanical stop, the procedure known from the state of the art is, for example, used. The emergency air point is detected in the current-less state of the adjusting device.

The adaptation is carried out when the control apparatus is taken into service after an original start, that is, after the battery cables have been disconnected and reconnected. The adaptation is also carried out for "ignition on" or is triggered externally by a tester.

If the throttle flap adjusting device is exchanged, a new adaptation must in each case be undertaken because the new element has other values than the element for which it was exchanged. The exchange of the adjusting device is detected by means of a computer program. This takes place in a preferred manner in that the emergency air position, which is present when the control apparatus is switched on (or rest position for an actuator without emergency air position), is compared to the emergency air position stored in the memory and learned in previous operating cycles. An actuator exchange is assumed if there are impermissible deviations outside of the usual tolerance. In the preferred embodiment, this is confirmed in that, after completion of the spring check at which the adjusting device is in the current-less state, the assumed emergency air position is supplemented or, in the alternative, is compared to the stored value. If impermissible deviations result, then an exchange of the throttle flap adjusting device and in this way an adaptation requirement is recognized.

In this case, the adaptation must in any event be completely executed so that it is ensured that the control of the engine is carried out on the basis of the newest characteristic values. Even though the adaptation can be triggered in the service facility via a tester, it must be ensured that the adaptation is entirely completed for "ignition on".

The adaptation is carried out only under specific peripheral conditions. An essential criterion for carrying out the adaptation is that the engine rotates maximally at the starter rpm, that is, that the engine does not run independently. If the starter rpm is exceeded (that is, if the engine starts), the uniform conditions necessary for the adaptation are no longer present. A satisfactory adaptation result cannot be ensured in this case so that the adaptation is interrupted when the starter rpm is exceeded. This is especially then damaging when the execution of the adaptation is absolutely necessary after an exchange of the adjusting device and/or after an original start but the driver wants to start the engine directly by rotating the ignition switch after switching on the ignition.

In order to ensure the execution of the adaptation, the ignition is inhibited for the duration of the adaptation (several seconds) when there is a detected adaptation requirement, especially after a detected exchange of the adjusting device or also after an original start. By suppressing the injection in this state, the engine rotates maximally only at the starter rpm so that the conditions under which an adaptation can take place are present and remain present for the duration of the adaptation. The driver cannot start the engine by rotating the ignition key so that the engine will only start with great delay in this operating situation.

In an advantageous embodiment, the injection inhibit is only outputted for the duration of the adaptation when an adaptation requirement was detected, that is, after a detected exchange of the adjusting device and/or for an original start, et cetera. If such an adaptation requirement is not detected, then the driver can prematurely interrupt the adaptation by rotating the ignition key so that the start of the engine is not delayed.

The procedure described is realized in the preferred embodiment as a program of the microcomputer 12. Such a program is shown in the flowchart of FIG. 2.

Figure 2:
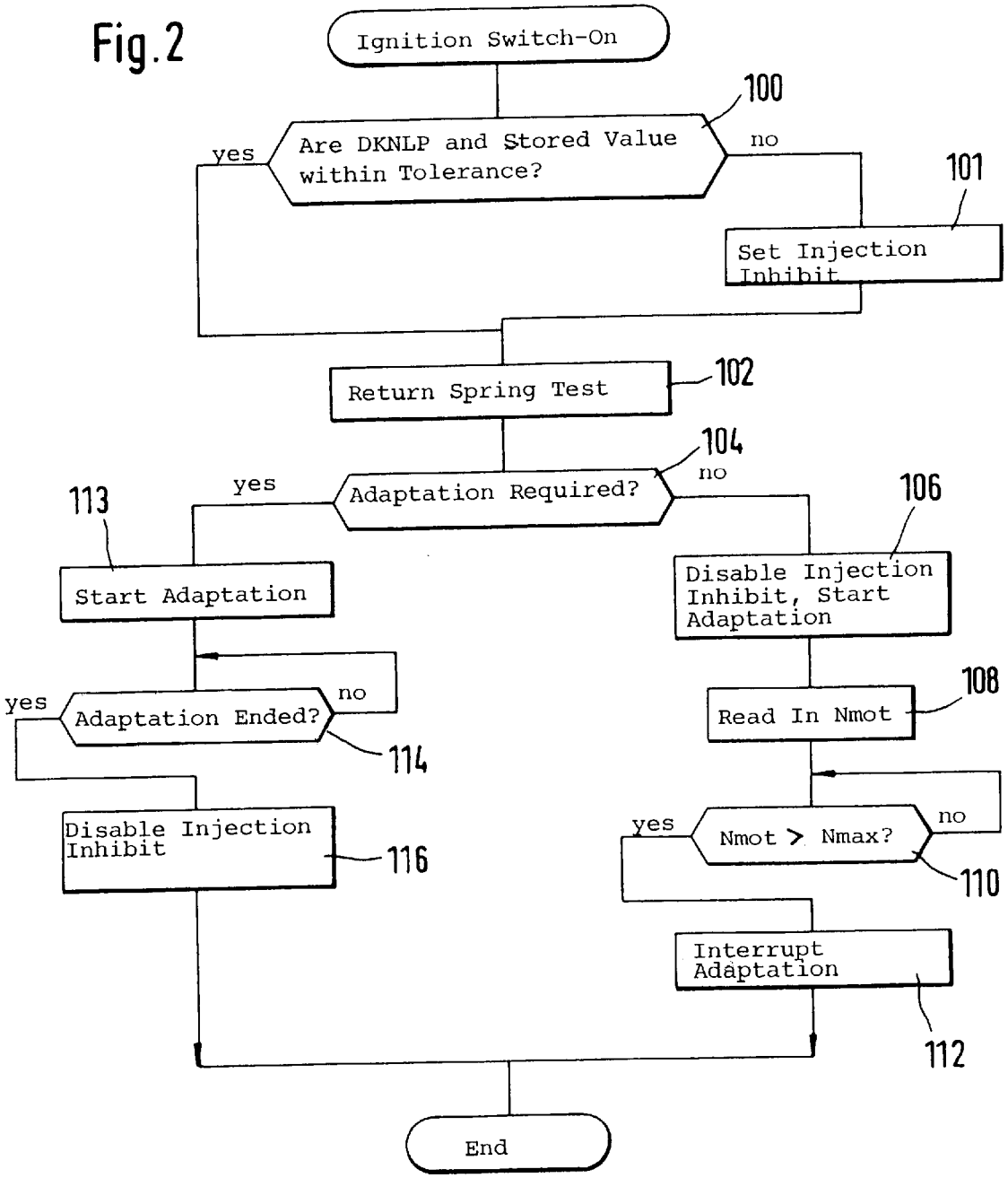
FIG. 2 shows a flowchart which presents a preferred realization for ensuring the execution of the adaptation operation as a computer program; and, FIGS. 3*a* to 3*c* show the operation of such a program with reference to time diagrams.

The program shown in FIG. 2 is started with the switch-on of the ignition. In the first step 100, the value DKNLP is compared to the learned value stored in the memory. The value DKNLP is the actual value assumed by the throttle flap and this value must correspond to the emergency air position when the accelerator pedal is not actuated. If both values are not within the pregiven tolerance, then, in step 101, a mark "injection inhibit" is set which indicates to the injection program that no injection is permitted. After step 101 or after step 100 in the case of a yes answer, the return spring test is carried out in the next step 102 and the position reached there is compared to the stored position. Thereupon, a check is made in inquiry step 104 as to whether an adaptation requirement is present. This is the case if an exchange of the throttle flap adjusting device is recognized on the basis of the comparison of the emergency air point to the stored value and/or on the basis of the adjustment for the return spring test. A requirement can also be recognized when an original start is present, that is, when the control apparatus is taken into service for the first time after the battery cables have been disconnected. The latter is recognized on the basis of an appropriate mark.

If no adaptation requirement is present, then, in step 106, the adaptation is started and the mark "injection inhibit" is disabled. The engine rpm (Nmot) is read in in step 108. Thereupon, in step 110, a check is made as to whether the engine rpm exceeds a maximum rpm Nmax. This maximum rpm is, as a rule, the starter rpm. If this is not the case, then step 110 is repeated while the adaptation started in step 106 continues to run. If the rpm Nmax is exceeded, then this adaptation is interrupted in accordance with step 112 and the program is ended.

If step 104 results in that no adaptation requirement is present, then the mark "injection inhibit" remains set. This means that a start of the engine is not possible because no injection pulses are outputted. The adaptation is started in step 113. Then, in step 114, a check is made as to whether the adaptation is ended. This inquiry is carried out until the adaptation is ended. In this case, and in accordance with step 116, the mark "injection inhibit" is removed (disabled) and the start of the engine is made possible. The program is ended after step 116.

Figure 3A:
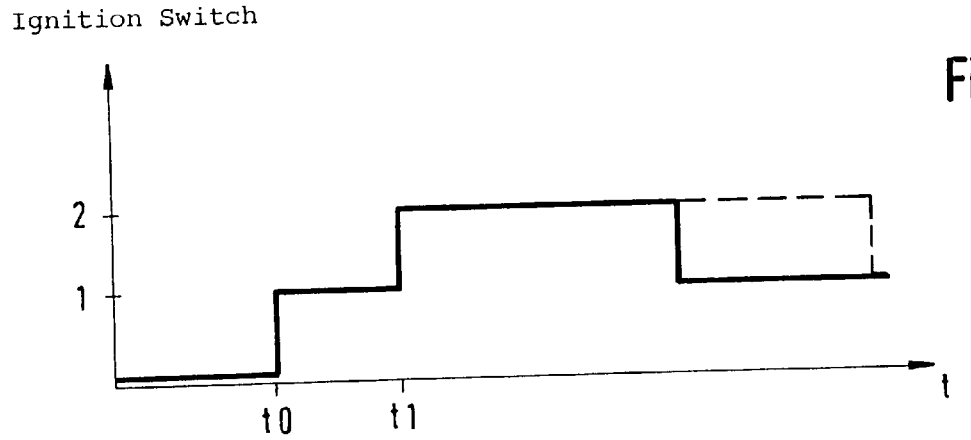
Figure 3B:
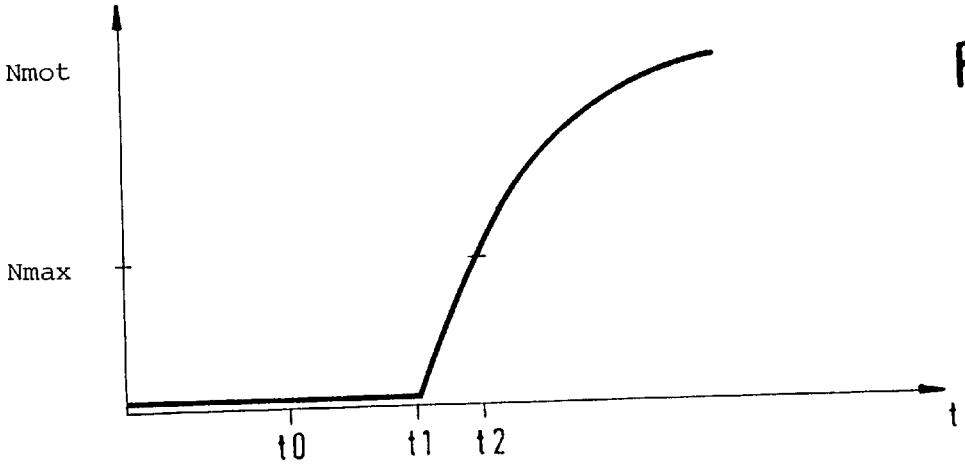
Figure 3C:
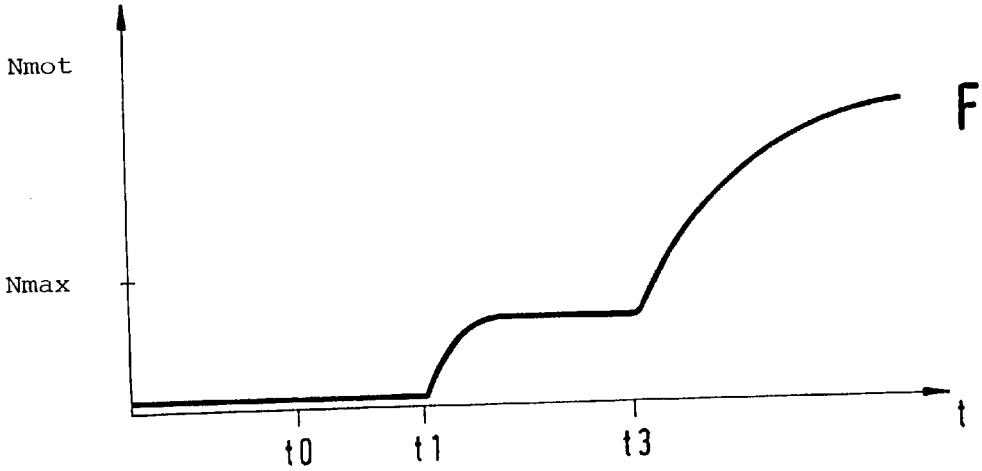

The effect of this procedure in a specific embodiment is presented in FIGS. 3*a* to 3*c* based on time diagrams. Here, FIG. 3*a* shows the particular assumed position of the ignition switch actuated by the driver; whereas in FIG. 3*b*, the trace of the engine rpm as a function of time for the case without adaptation requirement is shown. In FIG. 3*c*, the case with the adaptation requirement is shown.

First, the system is switched off. At time point $t_0$, the driver rotates the ignition switch into its first position, that is, into the position "ignition on". The engine rpm remains 0. At this time point, and in correspondence to steps 100 to 104, the return spring test is carried out, the adaptation requirement is determined and the adaptation is started. At time point $t_1$, the driver rotates the ignition switch into its second position in order to start the engine. This means that starting at time point $t_1$ the engine rpm increases under the action of the starter. If no adaptation requirement is present, then injection takes place immediately in order to start the engine. This leads to a rapid increase in rpm so that the rpm, as shown in FIG. 3*b*, exceeds the maximum value at time point $t_2$. At this time point, the adaptation is interrupted.

The situation is otherwise when an adaptation requirement is present (FIG. 3*c*). During the entire adaptation time, the injection is inhibited. For this reason, starting at time point $t_1$, the engine can rotate at the most at the rpm of the starter which is below or equal to the maximum rpm Nmax. At time point $t_3$, the adaptation is ended so that, at this time point, the injection is again permitted. The rpm then exceeds the maximum rpm and the engine is started.

Supplementary or as an alternative to the determination of an adaptation requirement on the basis of the return spring test, in one embodiment, the adaptation requirement is determined based on the current through the motor controlling the throttle flap or based on the drive signal for this motor. If the minimum stop has changed compared to the stored value, for example, because of an actuator exchange, then the throttle flap is controllably driven against the stop. If the throttle flap is controllably driven to its minimum stop, then no compensation of the control loop takes place so that the current through the motor or the quantity of the drive signal increase significantly. This performance is utilized in step 104 in lieu of or supplementary to the evaluation of the return spring test in order to determine an actuator exchange. In the preferred embodiment, this is carried out when the rest position of the flap is disposed within the tolerance.

It is understood that the foregoing description is that of the preferred embodiments of the invention and that various changes and modifications may be made thereto without departing from the spirit and scope of the invention as defined in the appended claims.

What is claimed is:

1. A method of operating an internal combustion engine equipped with a voltage supply and an electrically actuable adjusting device for adjusting an operating variable of said engine, the method comprising the step of inhibiting the output of an injection pulse for a predetermined time when doing at least one of the following: exchanging said adjusting device and when taking said engine into service for the first time after having disconnected said voltage supply.

2. The method of operating an internal combustion engine of claim 1, comprising the further step of determining at least one characteristic variable used in the control of said engine in the context of at least one adaptation operation.

3. The method of operating an internal combustion engine of claim 2, wherein said predetermined time is the time needed for the run-through of one adaptation.

4. The method of operating an internal combustion engine of claim 2, wherein said engine includes measurement amplifiers having offset and/or slope factors and said adjusting device includes a throttle flap having a lower mechanical stop; said throttle flap being controlled by said adjusting device and said throttle flap having an emergency air position; and, wherein said method comprises the further step of determining said lower mechanical stop, said emergency air position and said factors in the context of at least one adaptation operation.

5. The method of operating an internal combustion engine of claim 2, comprising the further step of interrupting said adaptation when there is no exchange of said adjusting device and no original start of said engine and the speed of said engine exceeds a predetermined limit value.

6. The method of operating an internal combustion engine of claim 2, comprising the further step of determining the exchange of said adjusting device by comparing the position of said adjusting device when switching on said ignition to a stored position.

7. The method of operating an internal combustion engine of claim 4, wherein said throttle flap has a return spring and wherein the method comprises the further step of conducting a test of said return spring; said adjusting device being switched to be without current and detecting an exchange of said adjusting device when the rest position deviates impermissibly from a stored position.

8. The method of operating an internal combustion engine of claim 4, the method comprising the further step of interrupting said adaptation when the engine rpm exceeds a predetermined rpm.

9. The method of operating an internal combustion engine of claim 8, wherein said engine is equipped with a starter; and, wherein said method comprises the further step of interrupting said adaptation when the engine rpm exceeds the rpm of said starter.

10. The method of operating an internal combustion engine of claim 4, wherein said adjusting device includes a motor for controlling said throttle flap; and, wherein said method comprises the further step of determining an exchange of said adjusting device from the current driving said motor or from the drive signal for said motor.

11. An arrangement for operating an internal combustion engine comprising:

an adjusting device for adjusting an operating variable of said engine;

an electronic control unit which drives said adjusting unit and outputs an injection pulse;

a voltage supply for said control unit; and, said electronic control unit functioning to inhibit the output of said injection pulse for a predetermined time when at least one of the following conditions are present: an exchange of said adjusting device and when said control apparatus is taken into service for the first time after said voltage supply has been disconnected.

* * * * *